US007625272B1

(12) United States Patent
Moreland et al.

(10) Patent No.: US 7,625,272 B1
(45) Date of Patent: Dec. 1, 2009

(54) COIN RECYCLING DEVICE

(75) Inventors: Flynt M. Moreland, Plano, TX (US); Doug Powers, Keller, TX (US)

(73) Assignee: Tidel Engineering, L.P., Carrollton, TX (US)

( * ) Notice: Subject to any disclaimer, the term of this patent is extended or adjusted under 35 U.S.C. 154(b) by 0 days.

(21) Appl. No.: 12/244,892

(22) Filed: Oct. 3, 2008

(51) Int. Cl.
*G07D 9/00* (2006.01)
*G07D 9/02* (2006.01)

(52) U.S. Cl. ..... 453/3; 141/358

(58) Field of Classification Search ..... 453/3; 193/DIG. 1, 28, 31 R, 31 A, 14, 34, 1, 17, 193/20–22, 2 A; 141/351, 352, 358, 129, 141/130, 132–137; 414/414; 198/359, 523, 198/528, 530, 535, 954; 221/99, 102, 178, 221/179, 180, 191–196; 206/0.83, 0.84; 232/1 D, 9, 43.2, 43.4, 55
See application file for complete search history.

(56) References Cited

U.S. PATENT DOCUMENTS 5,997,395 A 12/1999 Geib et al.
6,139,418 A 10/2000 Geib et al.
6,196,913 B1 3/2001 Geib et al.
6,318,537 B1 * 11/2001 Jones et al. ..... 194/346
6,755,730 B2 6/2004 Geib et al.
6,783,452 B2 8/2004 Hino et al.
6,983,836 B2 1/2006 Adams et al.
6,991,530 B2 1/2006 Hino et al.
7,004,831 B2 2/2006 Hino et al.
7,244,175 B2 7/2007 Adams et al.
7,255,639 B2 8/2007 Abe et al.
7,500,568 B2 * 3/2009 Cousin ..... 209/534
2004/0231956 A1 * 11/2004 Adams et al. ..... 194/217
2005/0096986 A1 5/2005 Taylor et al.

FOREIGN PATENT DOCUMENTS

EP 1624418 2/2006

* cited by examiner

*Primary Examiner*—Patrick Mackey
*Assistant Examiner*—Mark Beauchaine
(74) *Attorney, Agent, or Firm*—Locke Lord Bissell & Liddell, LLP

(57) ABSTRACT

A coin recycling device for receiving a batch of mixed denomination coins, for sorting the mixed denomination coins into a plurality of sorted denomination coins and for dispensing the sorted denomination coins in coin denomination order includes a coin sorter for receiving and sorting the batch of mixed denomination coins. A first manifold includes a plurality of coin paths for receiving the sorted denomination coins from the coin sorter. A plurality of coin hoppers store the sorted denomination coins which are received from the first manifold. Each of the coin hoppers store one sorted denomination coin and is operable to dispense coins stored therein. A second manifold receives coins from the coin hoppers and directs the coins in coin denomination order for subsequent dispensing into a coin receiver having a plurality of coin storage locations. The coin storage locations receive coins via the second manifold, such that the coins from the hopper are dispensed to the coin storage locations in coin denomination order.

3 Claims, 7 Drawing Sheets

COIN RECYCLING DEVICE

TECHNICAL FIELD OF THE INVENTION

The present invention relates to the recycling of coins, and more particularly to a device for sorting mixed denomination coins and for dispensing sorted denomination coins in denomination order.

BACKGROUND OF THE INVENTION

Recycling of coins is typically done in retail operations where a batch of mixed denomination coins is sorted for subsequent use. A cashier at the beginning of a shift, requires a cash till drawer to be filled with coins. The cash till drawer is typically arranged in coin denomination order. During the cashier's shifts, the cashier may require additional change to add to the till drawer. Coin change cups are utilized for receiving coins to be added to a cash till drawer.

In a coin sorter, coins are typically sorted from a mixed denomination batch of coins based upon the size of the coin in the following order: dime, cent, nickel, quarter dollar, dollar and half dollar. Since cash till drawers are typically organized in coin denomination order, the need has arisen for a coin recycling device for reorganizing sorted denomination coins by coin value rather than size, and for dispensing ordered denomination coins directly into the compartments of a cash till drawer or present them in an order that can easily be moved from the coin recycling device to a cash till drawer.

SUMMARY OF THE INVENTION

In accordance with the present invention, a coin recycling device for receiving a batch of mixed denomination coins, for sorting the mixed denomination coins into a plurality of sorted denomination coins and for dispensing the sorted denomination coins in coin denomination order is provided. The device includes a housing having a coin input area for receiving the batch of mixed denomination coins. A coin sorter is disposed in the housing for receiving and sorting the batch of mixed denomination coins. A first manifold includes a plurality of coin paths for receiving the sorted denomination coins from the coin sorter. A plurality of coin hoppers store the sorted denomination coins which are received from the first manifold. Each of the coin hoppers store one sorted denomination coin and is operable to dispense coins stored therein. A second manifold receives coins from the coin hoppers and directs the coins in coin denomination order for subsequent dispensing from the housing into a coin receiver having a plurality of coin storage locations. The coin storage locations receive coins via the second manifold, such that the coins from the hopper are dispensed to the coin storage locations in coin denomination order. The coin receiver may comprise compartments of a cash till drawer or coin change cups.

BRIEF DESCRIPTION OF THE DRAWINGS

The apparatus of the invention is further described and explained in relation to the following drawings wherein.

DESCRIPTION OF THE PREFERRED EMBODIMENTS

Figure 1:
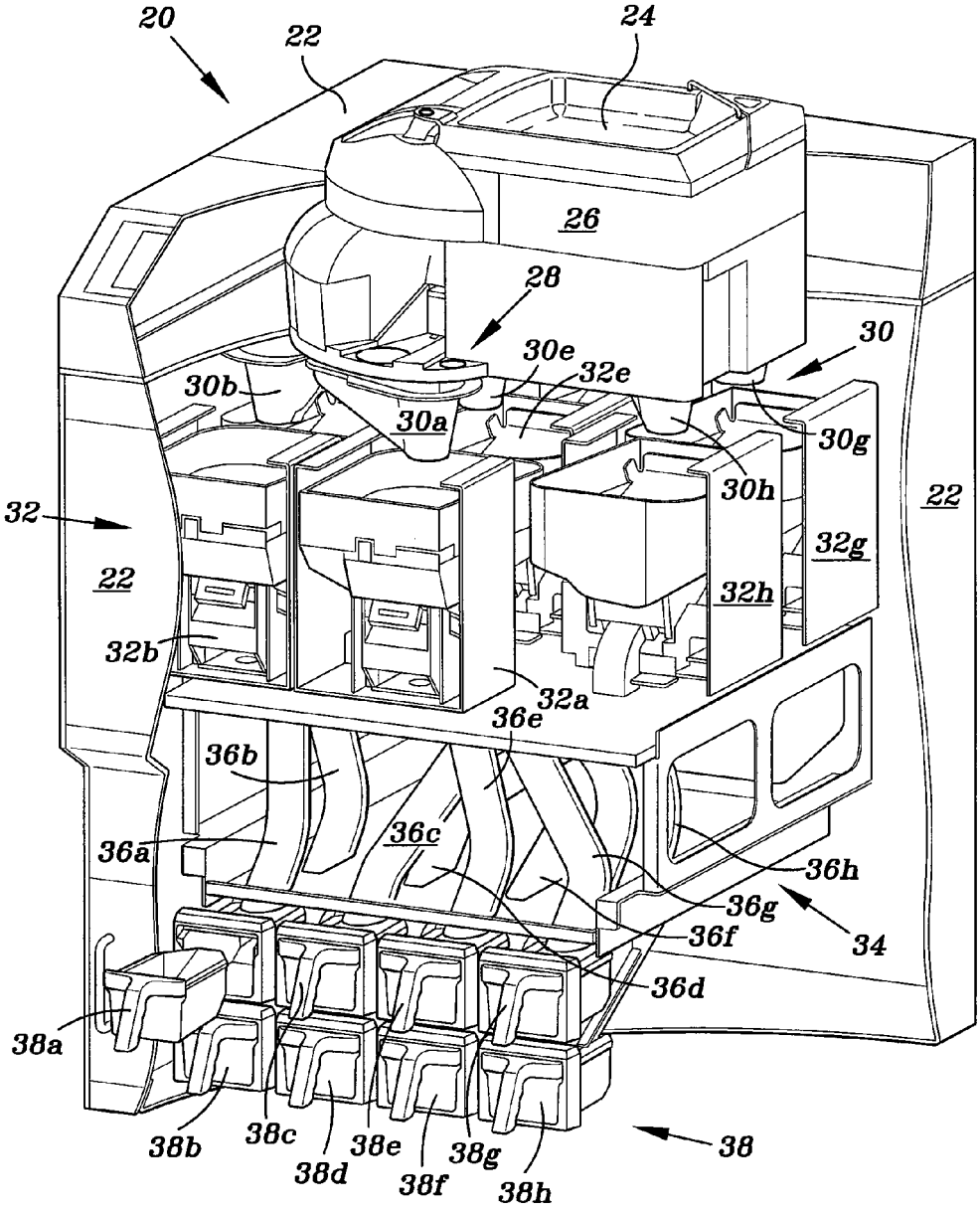
FIG. 1 is a perspective view of the present coin recycling device for use with coin change cups.
Figure 2:
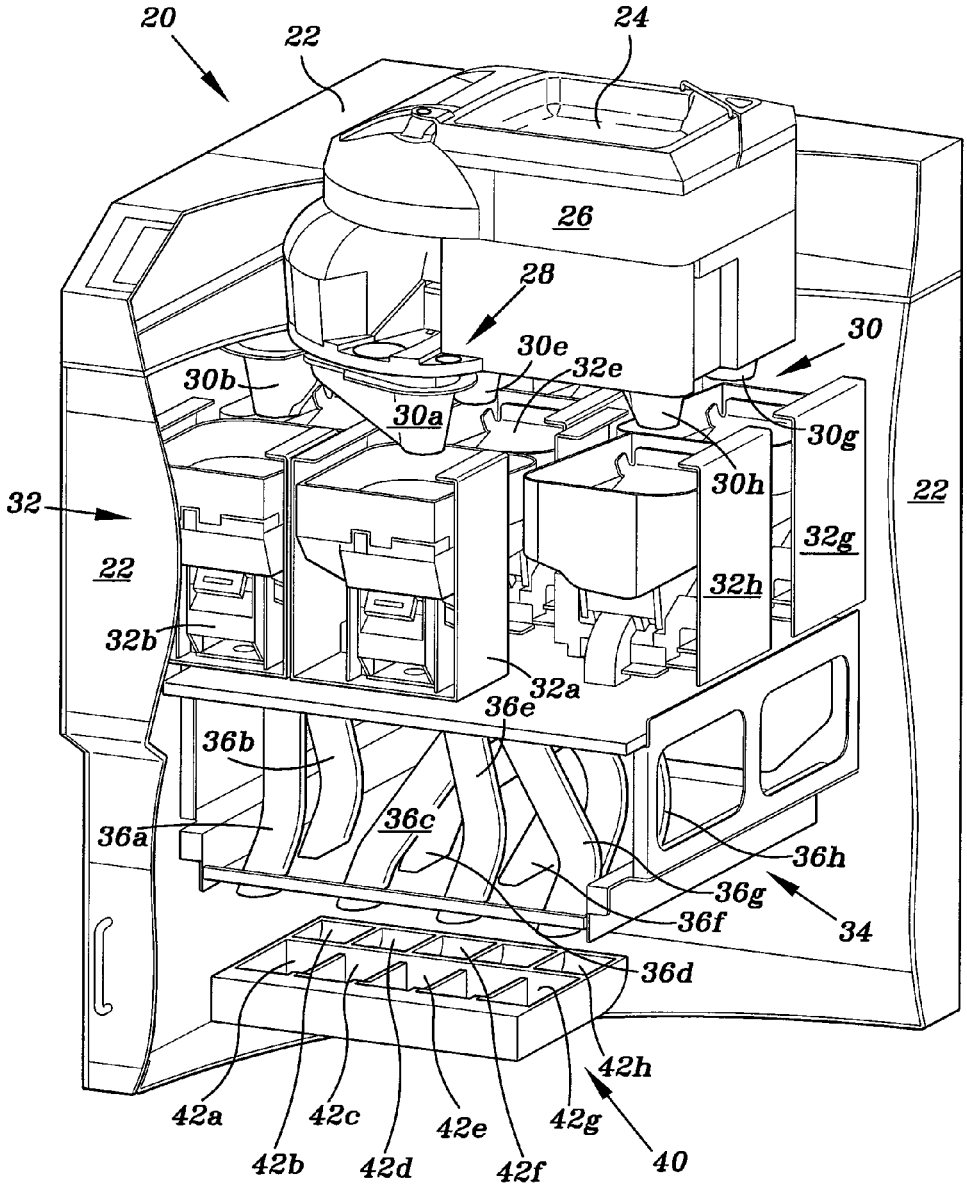
FIG. 2 is a perspective view of the present coin recycling device for use with a cash till drawer.

Referring simultaneously to FIGS. 1 and 2, the present coin recycling device is illustrated, and is generally identified by the numeral 20. Coin recycling device 20 receives a batch of mixed denomination coins, sorts the mixed denomination coin batch into a plurality of sorted denomination coins and further dispenses the sorted denomination coins in coin denomination order to a coin received such as, for example, coin change cups as illustrated in FIG. 1 and a cash till drawer as illustrated in FIG. 2.

Coin recycling device 20 includes a housing 22 including a coin input area 24 for receiving a batch of mixed denomination coins. Coin input area 24 is disposed adjacent to a coin sorter 26 which receives and sorts the batch of mixed denomination coins into a plurality of sorted denomination coins based on the size of each coin in the batch of mixed denomination coins. Sorter 26 is comprised, for example, sorters described in U.S. Pat. Nos. 5,997,395; 6,196,913; 6,983,836; and 7,244,175.

Figure 3:
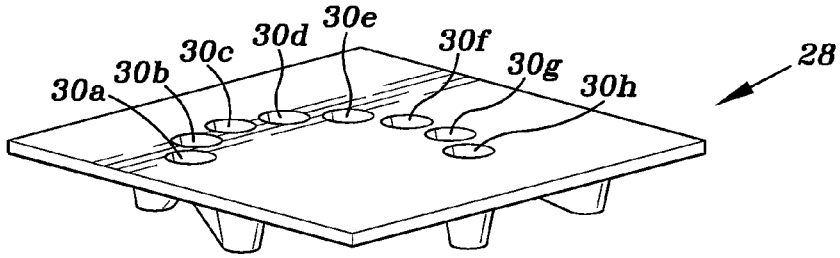
FIG. 3 is a top perspective view of the first manifold illustrated in FIGS. 1 and 2.
Figure 4:
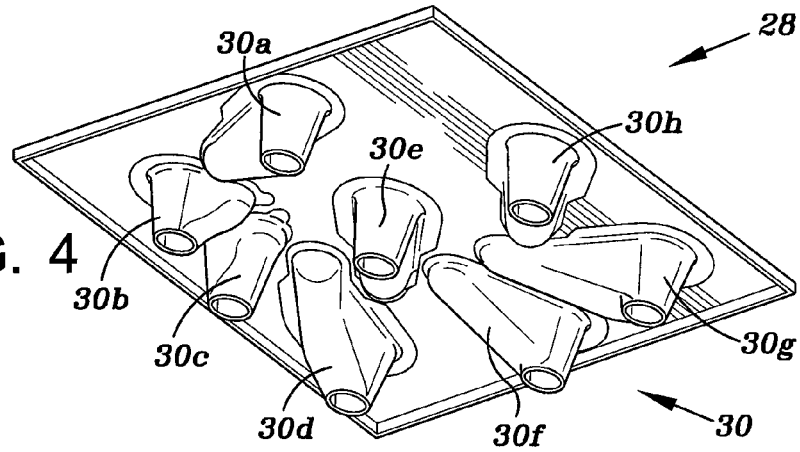
FIG. 4 is a bottom perspective view of the first manifold illustrated in FIGS. 1 and 2.

Coins are dispensed from coin sorter 26 by coin denomination based upon the size of the coin. Coins are dispensed from coin sorter 26 to a first manifold, generally identified by the numeral 28. First manifold 28 includes a plurality of coin paths 30, each path 30 receiving sorted denomination coins from the coin sorter 26. Paths 30 include multiple paths 30*a*, 30*b*, 30*c*, 30*d*, 30*e*, 30*f*, 30*g* and 30*h*, more particularly illustrated in FIGS. 3 and 4. Paths 30*a*-30*h* each correspond to one denomination of coins with path 30*a* receiving coins of the smallest diameter, a dime, and path 30*h* receiving coins of the largest diameter, a half dollar.

Disposed adjacent to manifold 30 is a plurality of coin hoppers 32, with one coin hopper positioned to receive coins from each of coin paths 30*a*-30*h*. Coin hoppers 32 include hoppers 32*a*-32*h*. Each coin hopper 32 stores one sorted denomination coin and is operable to dispense coins stored therein.

Figure 5:
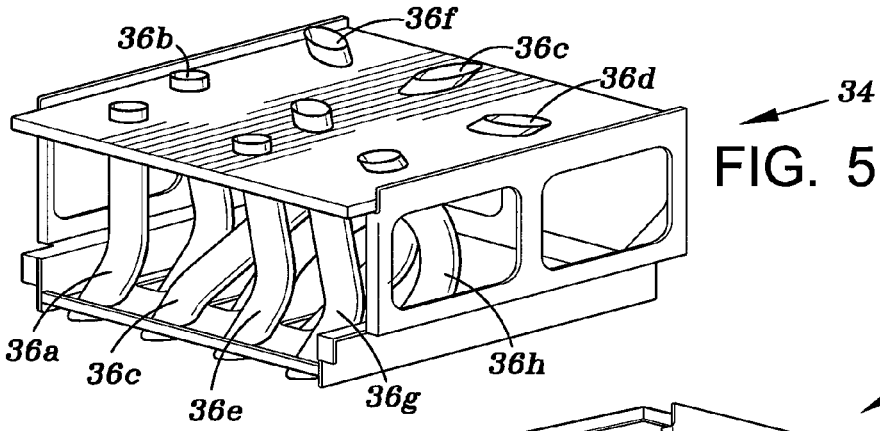
FIG. 5 is a top perspective view of the second manifold illustrated in FIGS. 1 and 2.
Figure 6:
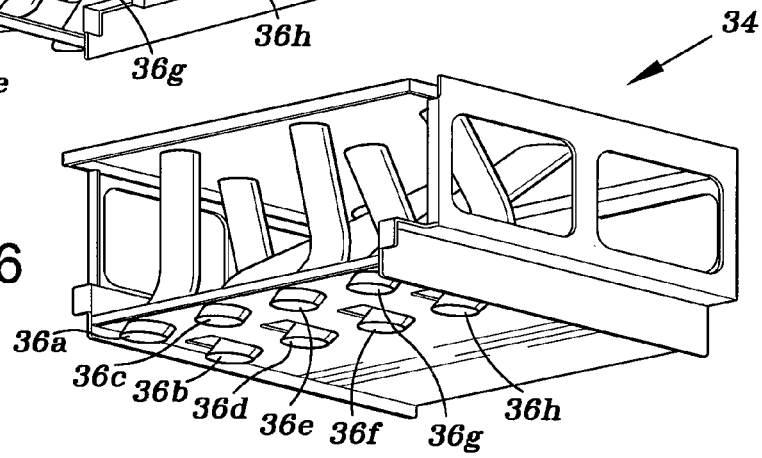
FIG. 6 is a bottom perspective view of the second manifold illustrated in FIGS. 1 and 2.

When desired, coins stored within coin hoppers 32 are dispensed to a second manifold 34. Second manifold 34 includes a plurality of coin paths 36, and more particularly paths 36*a*-36*h*, as more clearly shown in FIGS. 5 and 6. Each coin path 36 receives stored denomination coins from one of coin hoppers 32 and directs the stored and sorted denomination coins from hoppers 32 in coin denomination order, that is, cent, nickel, dime, quarter dollar, half dollar and dollar.

Second manifold 34 dispenses coins in coin denomination order into a coin receiver such as, for example, coin change cups 38 as illustrated in FIG. 1 or, alternatively to a cash till drawer 40, illustrated in FIG. 2. Coin change cups 38 include individual coin change cups 38*a*-38*h* which communicate and receive coins from a corresponding one of coin paths 36*a*-36*h* of second manifold 34, such that coins are dispensed and received in cups 38*a*-38*h* in coin denomination order. Similarly, cash till drawer 40 includes a plurality of coins storage locations 42*a*-42*h* each communicate with and receive coins from coin paths 36*a*-36*h* of second manifold 34, such that coins from hoppers 32 are dispensed to compartments 42*a*-42*h* of cash till drawer 40 in coin denomination order.

Movement of coins through manifolds 30 and 34, and coin hoppers 32 may be accomplished, for example, by gravity, or kinetic energy or a combination of both.

Figure 7:
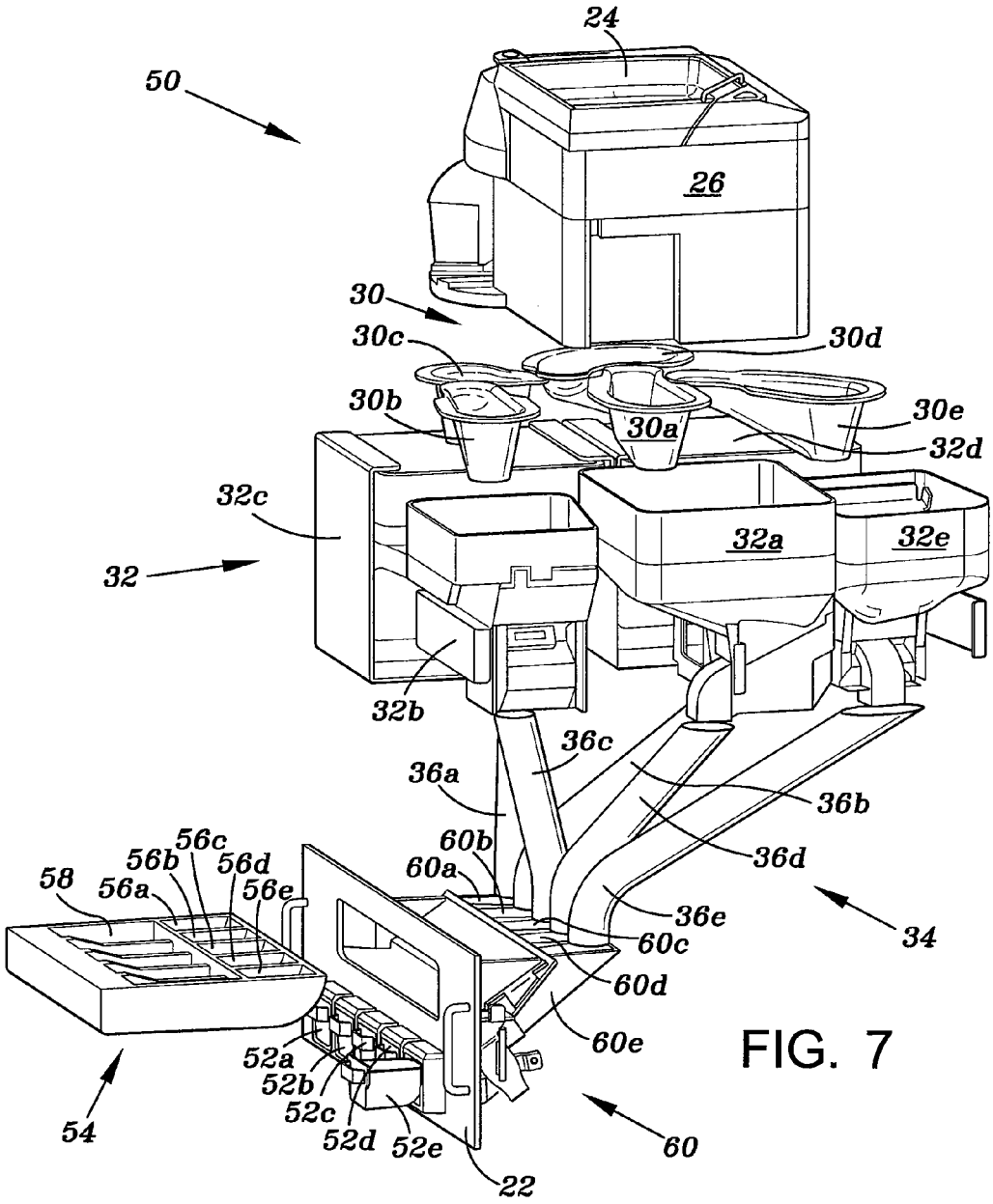
FIG. 7 is a perspective view of a further embodiment of the present invention illustrating a third manifold.

Referring now to FIG. 7, an additional embodiment of the present coin recycling device is illustrated, and is generally then defined by the numeral 50. Coin recycling device 50 includes a coin sorter 26, first manifold 30, coin hoppers 32 and a second manifold 34 as previously described with respect to coin recycling device 20; however, coin recycling device 50 sorts five coin denominations whereas coin recycling device 20 includes the capability of sorted coins having eight denominations.

Coin recycling device 50 is capable of dispensing sorted coins in coin denomination order into coin change cups 52, 52*a*, 52*b*, 52*c*, 52*d* and 52*e*; or alternatively into a cash till drawer 54 having coin compartments 56, 56*a*, 56*b*, 56*c*, 56*d* and 56*e* which receive coins in coin denomination order from second manifold 34. Cash till drawer 54 also includes compartments 58 for receiving paper currency.

Figure 8:
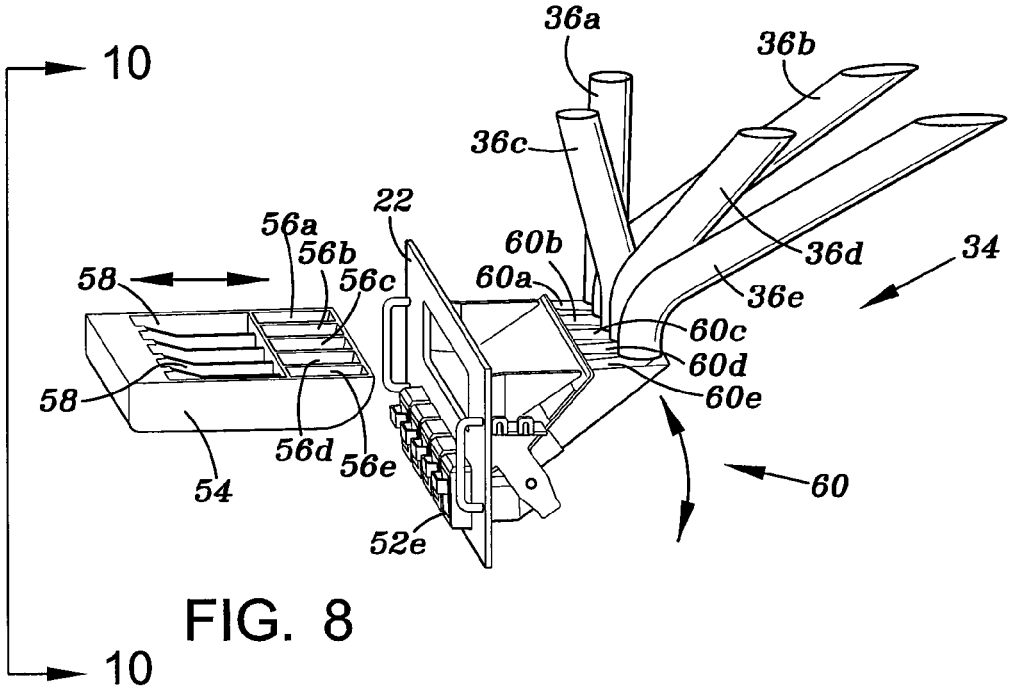
FIG. 8 is a perspective view of a portion of the present coin recycling device shown in FIG. 7 illustrating operation of the third manifold for dispensing coins into coin change cups.
Figure 10:
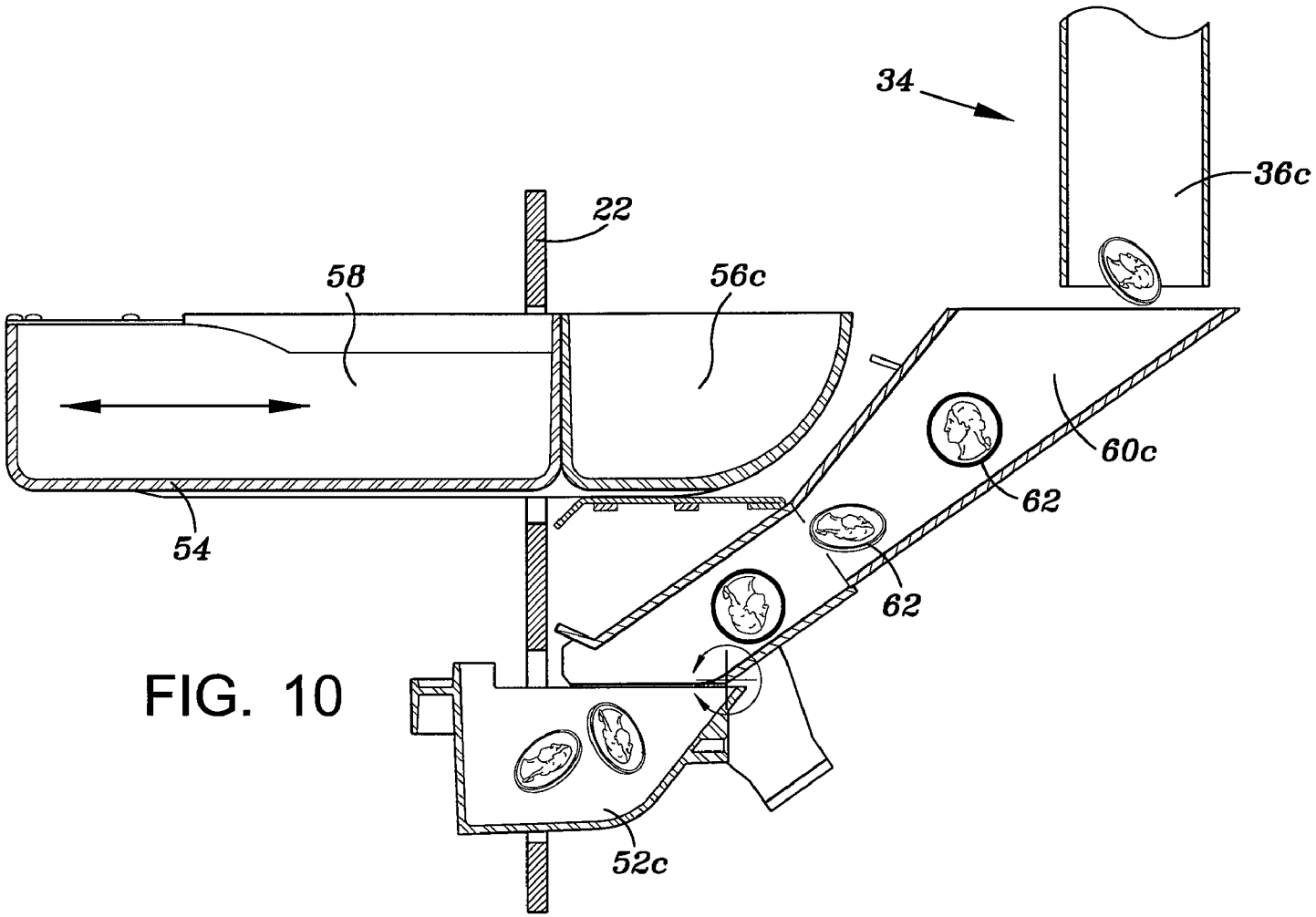
FIG. 10 is an enlarged sectional view taken generally along sectional lines 10-10 of FIG. 8.

Referring simultaneously to FIGS. 7, 8 and 10, coin recycling device 50 includes a third manifold 60 including a plurality of coin paths 60*a*, 60*b*, 60*c*, 60*d* and 60*e*. Coin paths 60*a*-60*e* communicate with coin paths 36*a*-36*e* of second manifold 34 to allow coins 62 (FIG. 10) to flow from coin hoppers 32 into coin change cups 52 when cash till drawer 54 is removed from coin recycling device 50. With cash till drawer 54 removed from coin recycling device 50, a direct path for coins exists from hoppers 32 to coin change cups 52 via second manifold 34 and third manifold 60.

Figure 9:
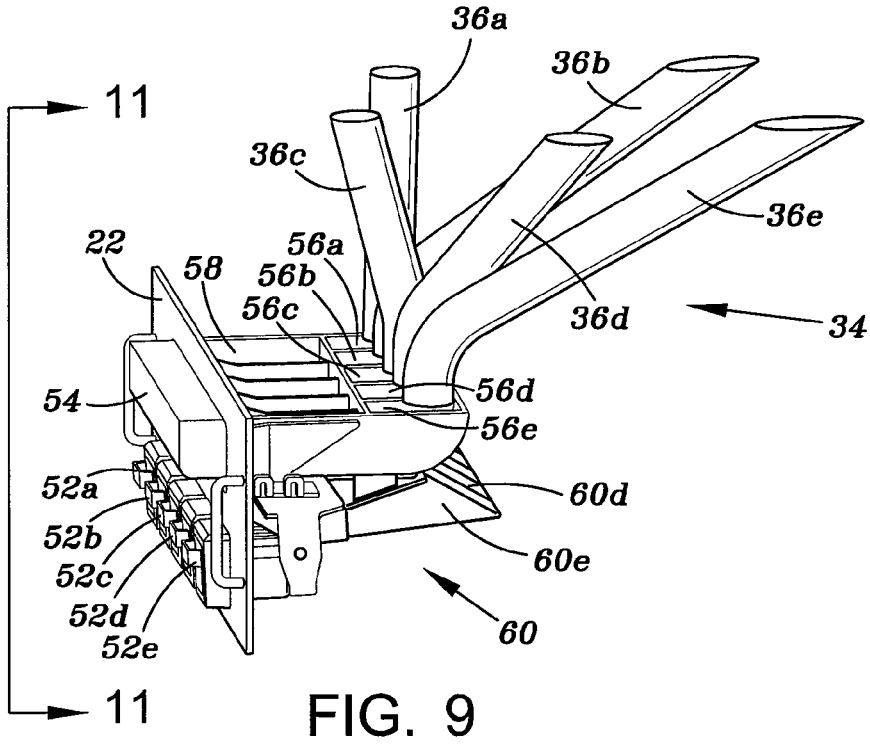
FIG. 9 is a perspective view of a portion of the present coin recycling device shown in FIG. 7 illustrating operation of the third manifold for filling compartments in a cash till drawer.
Figure 11:
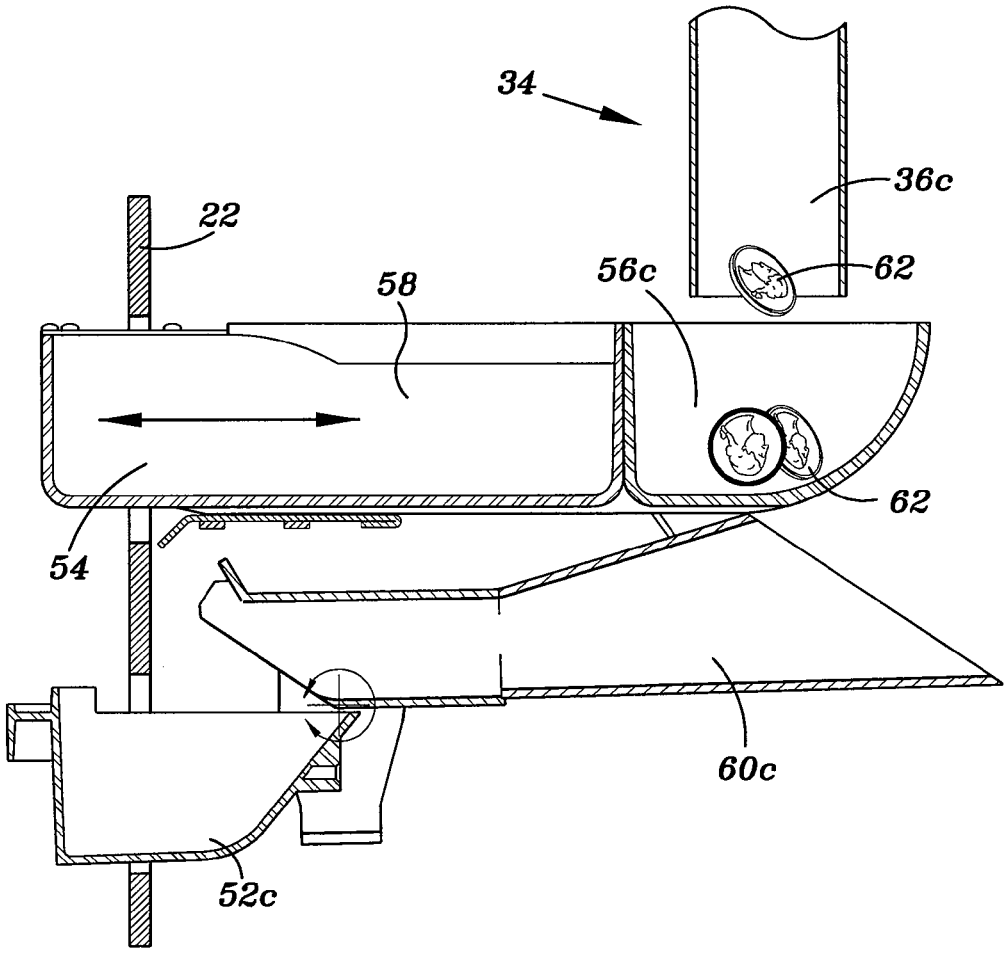
FIG. 11 is an enlarged sectional view taken generally along sectional lines 11-11 of FIG. 9.

Referring to now to FIGS. 7, 9 and 11, cash till drawer 54 is inserted into coin recycling device 50 which causes manifold 60 to pivot, in a clockwise manner, such that compartments 56 align directly with coin paths 36 of manifold 34. Coins 62 are dispensed directly into compartments 56 of cash till drawer 54. Cash till drawer 54 blocks coins 62 from flowing into manifold 60, thereby preventing coins 62 from entering coin change cups 52.

Coin recycling device 50 may include, for example, a sensor to insure that cash till drawer 54 is properly inserted into coin recycling device 50 so that compartments 56 align with coin paths 36.

The invention claimed is:

1. A coin recycling device for receiving a batch of mixed denomination coins, for sorting the mixed denomination coins into a plurality of sorted denomination coins and for dispensing the sorted denomination coins, the device comprising:

a housing;

said housing including a coin input area for receiving the batch of mixed denomination coins deposited into said housing;

a coin sorter disposed in said housing for receiving and sorting the batch of mixed denomination coins into a plurality of sorted denomination coins based on the size of each coin in the batch of mixed denomination coins;

a first manifold having a plurality of coin paths for receiving the sorted denomination coins from said coin sorter;

a plurality of coin hoppers for storing sorted denomination coins received from said first manifold coin paths, each of said coin hoppers storing one sorted denomination coins and operable to dispense coins stored therein;

a second manifold having a plurality of coin paths, one of said coin paths for receiving stored denomination coins from one of said coin hoppers, said second manifold coin paths direct stored and sorted denomination coins from said hoppers in coin denomination order for dispensing from said housing;

a plurality of coin change cups disposed within said housing;

a cash till drawer having a plurality of compartments, said cash till drawer being selectively insertable into said housing; and a third manifold having a plurality of coin paths; one of said coin paths disposed in communication with one of said second manifold coin paths for directing coins to said plurality of coin change cups, wherein said third manifold coin paths are moveable between a first position in communication with said second manifold and a second position not in communication with said second manifold, such that in said second position coins are dispensed from said second manifold coin paths directly into said cash till drawer compartments when said cash till drawer is inserted into said housing and wherein movement of said third manifold coin paths between said first and second positions is controlled by insertion of said cash till drawer into said housing.

2. A coin recycling device for dispensing sorted denomination coins, the device comprising:

a housing;

a plurality of coin hoppers disposed within said housing for storing sorted denomination coins, each of said coin hoppers storing one sorted denomination coins and operable to dispense coins stored therein;

a plurality of coin change cups disposed within said housing;

a cash till drawer having a plurality of compartments, said cash till drawer being selectively insertable into said housing;

a manifold having a plurality of coin paths; one of said coin paths disposed in communication with one of said coin hoppers for directing coins to said plurality of coin change cups; and said manifold coin paths are moveable between a first position in communication with said coin hoppers and a second position not in communication with said coin hoppers, such that in said second position coins are dispensed from said coin hoppers directly into said till drawer compartments when said cash till drawer is inserted into said housing.

3. The coin recycling device of claim 2 wherein movement of said manifold coin paths between said first and second positions is controlled by insertion of said cash till drawer into said housing.

* * * * *